US011326851B1

(12) United States Patent
Oldham

(10) Patent No.: US 11,326,851 B1
(45) Date of Patent: May 10, 2022

(54) AUTOMATIC RIFLE STORAGE ASSEMBLY

(71) Applicant: James Oldham, Aurora, CO (US)

(72) Inventor: James Oldham, Aurora, CO (US)

( * ) Notice: Subject to any disclaimer, the term of this patent is extended or adjusted under 35 U.S.C. 154(b) by 0 days.

(21) Appl. No.: 17/183,795

(22) Filed: Feb. 24, 2021

(51) Int. Cl.
*F41A 23/18* (2006.01)
*A47B 81/00* (2006.01)

(52) U.S. Cl.
CPC ..... *F41A 23/18* (2013.01); *A47B 81/005* (2013.01)

(58) Field of Classification Search
CPC ..... F41A 23/18; A47B 81/005
See application file for complete search history.

(56) References Cited

U.S. PATENT DOCUMENTS 3,007,581 A * 11/1961 Moore ..... A01M 31/00 211/64
3,917,071 A * 11/1975 Walters ..... E05B 73/00 211/64
3,952,878 A 4/1976 Gorham
4,450,989 A * 5/1984 Bogar, Jr. ..... A47B 81/005 211/64
4,648,516 A * 3/1987 Elkins ..... A47B 81/005 211/64
4,747,280 A * 5/1988 Shaw ..... E05B 47/0002 211/64
4,776,471 A * 10/1988 Elkins ..... A47B 57/52 211/64
4,852,780 A * 8/1989 Woodbury ..... B60R 7/14 224/483
5,438,787 A 8/1995 McMaster
D365,715 S 1/1996 Zebbedies
5,887,730 A 3/1999 St. George
6,935,065 B1 * 8/2005 Oliver ..... F41A 23/04 211/64
7,124,530 B1 * 10/2006 Clark ..... F41A 23/18 42/94
7,137,511 B1 * 11/2006 Crowell ..... F41A 23/18 211/4
7,380,893 B2 * 6/2008 Burigana ..... A47B 49/00 312/310
7,467,719 B2 12/2008 Crowell
D611,558 S * 3/2010 Freeman ..... D22/108
8,657,127 B2 2/2014 Diaz, Jr.
8,910,560 B2 * 12/2014 Irwin ..... B60R 7/14 89/37.01
9,708,835 B2 * 7/2017 Fisher ..... B60R 7/14
9,884,593 B2 * 2/2018 Hull ..... A47B 96/1475
9,885,534 B2 2/2018 Boggess
(Continued)

FOREIGN PATENT DOCUMENTS

EP 3249343 11/2017
EP 3249343 B1 * 12/2018 ..... F41A 23/02
(Continued)

*Primary Examiner* — Stanton L Krycinski

(57) ABSTRACT

An automatic rifle storage assembly for storing an automatic rifle includes a first member that is mountable to a vertical support surface. A cup is coupled to and extends away from the first member to receive a muzzle of an automatic rifle. A second member is slidably inserted into the first member and the second member is mountable to the vertical support surface. A clamping unit is coupled to the second member to releasably engage a buffer tube of the automatic rifle for storing the automatic rifle in a vertical orientation.

10 Claims, 5 Drawing Sheets

(56) References Cited

U.S. PATENT DOCUMENTS

| | | | | |
|---|---|---|---|---|
| 9,984,667 | B2 * | 5/2018 | Walker | F16M 11/041 |
| 10,125,919 | B2 * | 11/2018 | Forsberg | B25H 3/00 |
| 10,144,358 | B2 * | 12/2018 | Fife | B60R 7/043 |
| 10,576,900 | B2 * | 3/2020 | Bornais | B60R 7/14 |
| 11,092,401 | B2 * | 8/2021 | Kubiniec | F41A 23/18 |
| 11,110,867 | B2 * | 9/2021 | Franklin | A47F 7/0021 |
| 2005/0145585 | A1 | 7/2005 | Pintar | |
| 2005/0167378 | A1 | 8/2005 | Scott | |
| 2010/0059639 | A1 * | 3/2010 | Truna | F41B 5/14 248/125.1 |
| 2011/0114580 | A1 * | 5/2011 | Chen | B25H 3/04 211/70.6 |
| 2011/0168649 | A1 | 7/2011 | Stolz | |
| 2015/0128668 | A1 * | 5/2015 | Meredith | G07C 9/00563 70/266 |
| 2018/0009362 | A1 * | 1/2018 | Abohammdan | B60P 3/00 |

FOREIGN PATENT DOCUMENTS

| | | | | |
|---|---|---|---|---|
| GB | 2170994 A | * | 8/1986 | A47B 81/005 |
| GB | 2277019 A | * | 10/1994 | A47B 81/005 |

* cited by examiner

AUTOMATIC RIFLE STORAGE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to rifle storage devices and more particularly pertains to a new rifle storage device for storing an automatic rifle.

(2) Description of Related Art Including Information Disclosed Under 37 CFR 1.97 and 1.98

The prior art relates to rifle storage devices including a rifle storage device that includes a cup for receiving a butt of a rifle and a clamp for releasably engaging a muzzle of a rifle. The prior art discloses a pole that is insertable into ground that includes a platform for supporting a butt of a rifle and a ring that restrains a barrel of a rifle. The prior art discloses a rifle storage device that includes a box for engaging a trigger guard of a rifle and a saddle for engaging a barrel of a rifle to store the rifle in a horizontal orientation. The prior art discloses a storage device that includes a pair of rails, each having closes loops mounted thereto for slidably receiving a butt of a rifle and a barrel of a rifle. The prior art discloses a variety of storage devices for storing a rifle in a vertical orientation with the barrel pointing upwardly from the butt. The prior art additionally discloses a variety of storage devices for storing a rifle in a horizontal orientation.

BRIEF SUMMARY OF THE INVENTION

An embodiment of the disclosure meets the needs presented above by generally comprising a first member that is mountable to a vertical support surface. A cup is coupled to and extends away from the first member to receive a muzzle of an automatic rifle. A second member is slidably inserted into the first member and the second member is mountable to the vertical support surface. A clamping unit is coupled to the second member to releasably engage a buffer tube of the automatic rifle for storing the automatic rifle in a vertical orientation.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
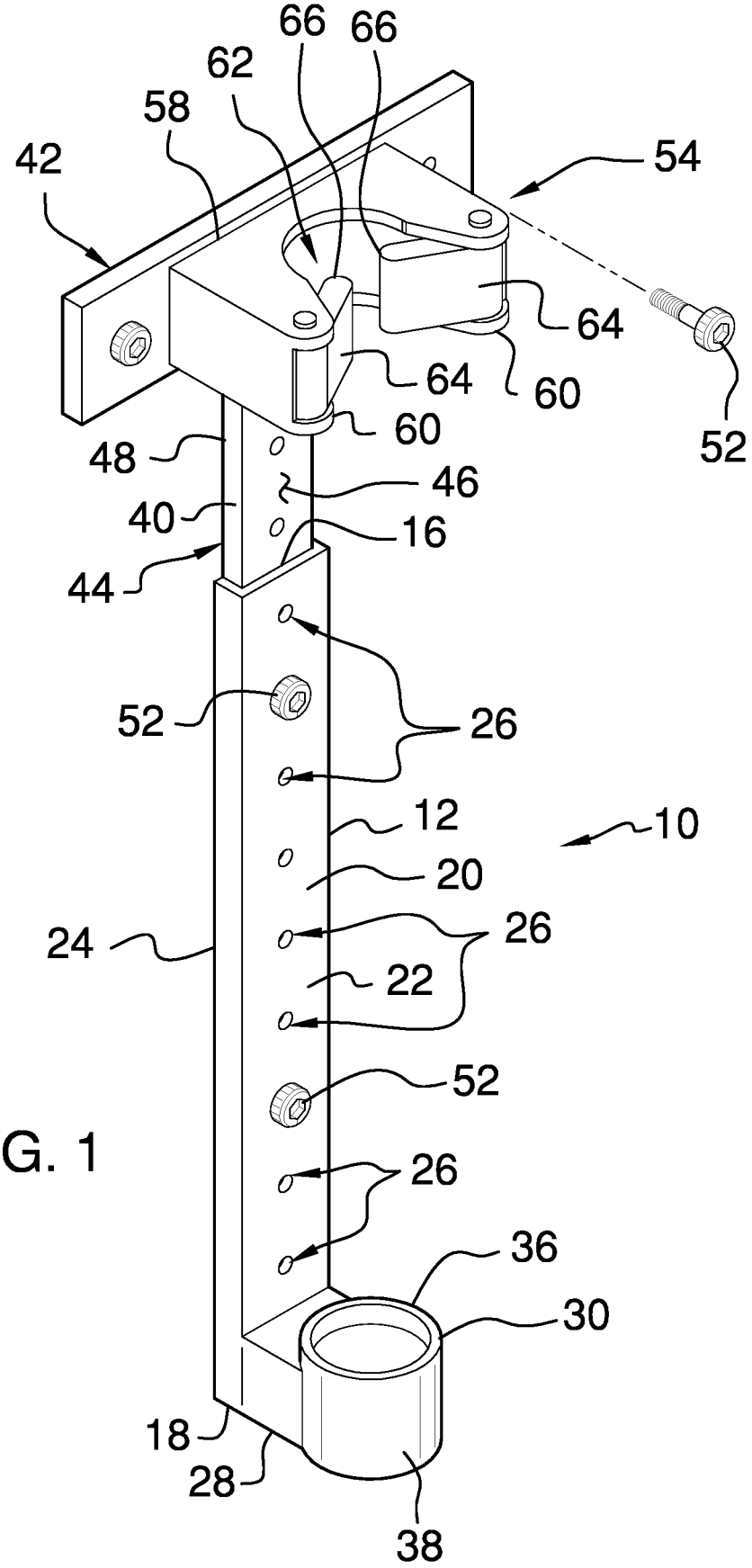
FIG. 1 is a front perspective view of an automatic rifle storage assembly according to an embodiment of the disclosure.
Figure 2:
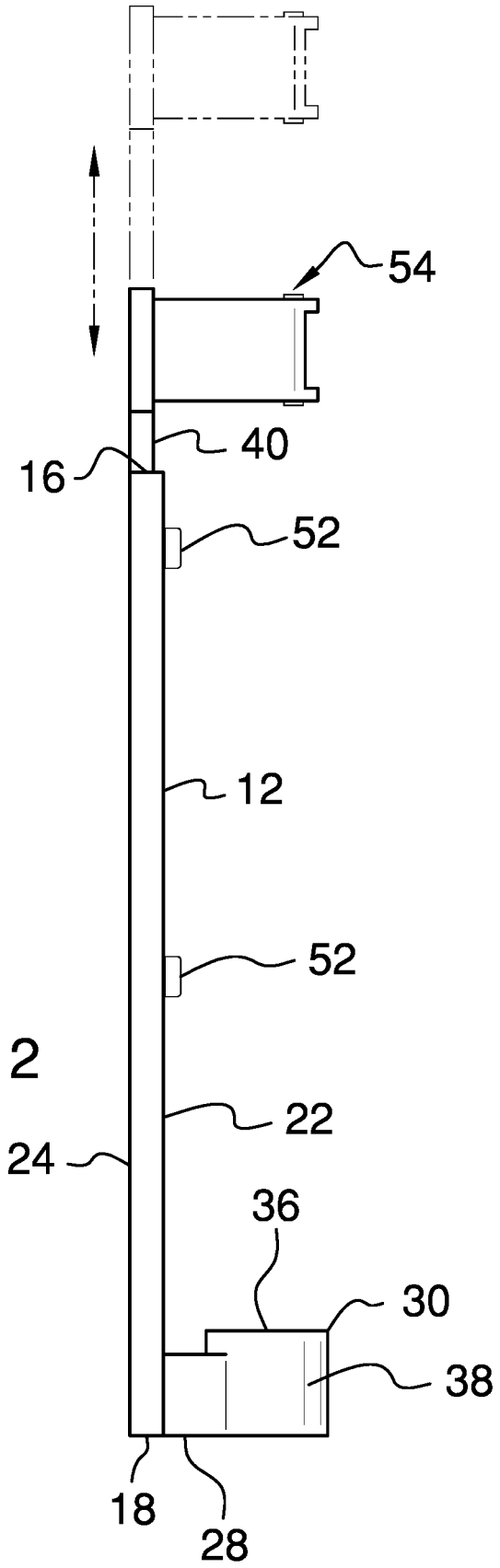
FIG. 2 is a right side view of an embodiment of the disclosure.
Figure 3:
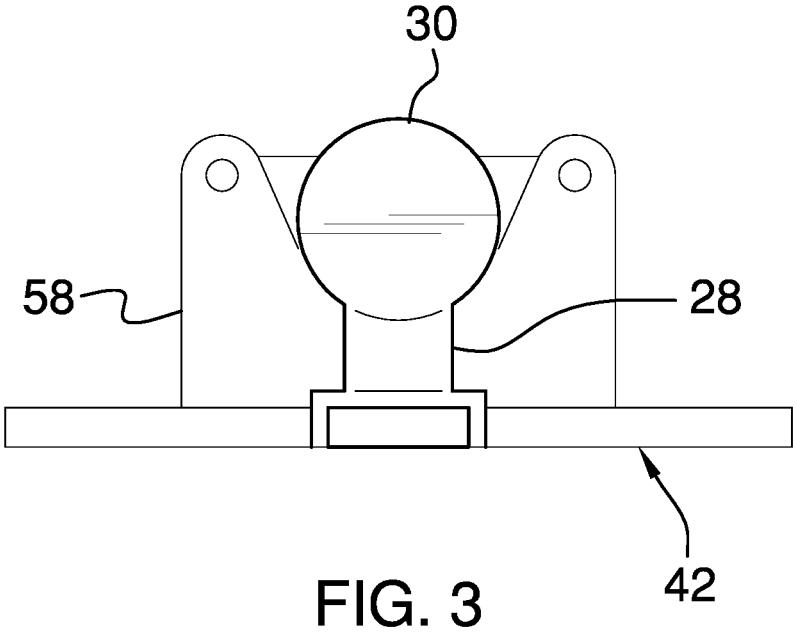
FIG. 3 is a bottom view of an embodiment of the disclosure.
Figure 4:
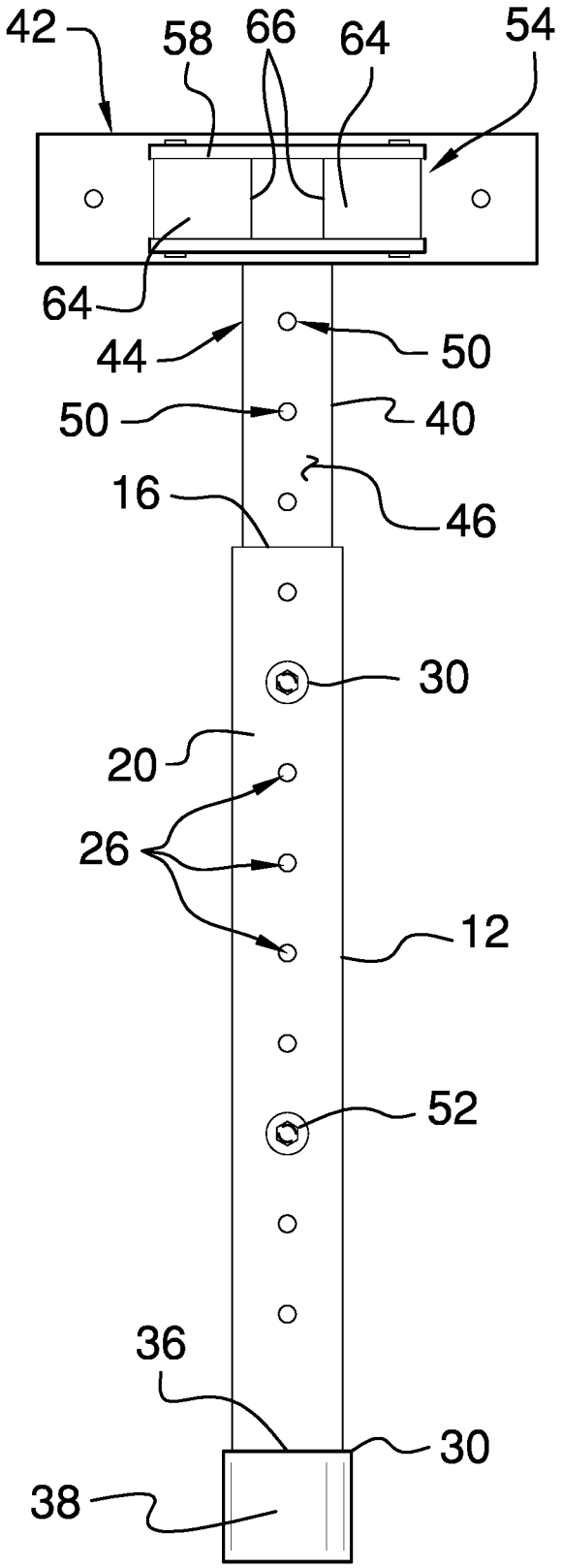
FIG. 4 is a front view of an embodiment of the disclosure.
Figure 5:
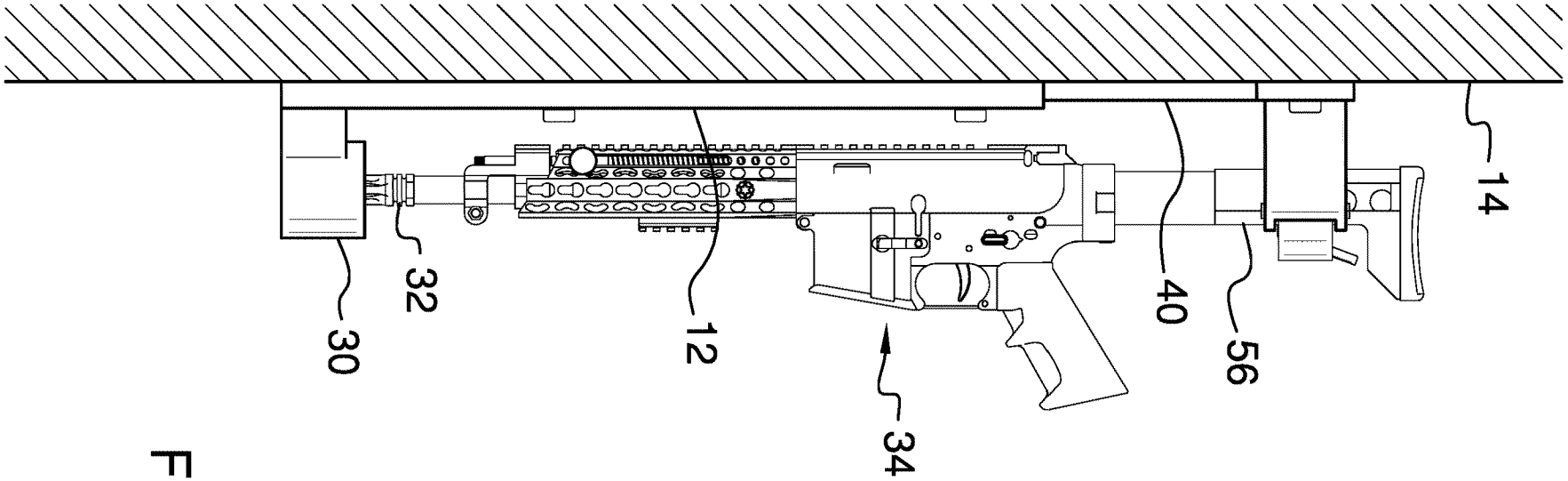
FIG. 5 is a perspective in-use view of an embodiment of the disclosure.

With reference now to the drawings, and in particular to FIGS. 1 through 5 thereof, a new rifle storage device embodying the principles and concepts of an embodiment of the disclosure and generally designated by the reference numeral 10 will be described.

As best illustrated in FIGS. 1 through 5, the automatic rifle storage assembly 10 generally comprises a first member 12 that is mountable to a vertical support surface 14. The vertical support surface 14 may be a wall in a room, a wall in a cab of a vehicle or any other similar vertical support surface. The first member 12 has a top end 16, a bottom end 18 and an outer wall 20 extending therebetween. The top end 16 is open, the first member 12 is hollow, and the outer wall 20 has a front side 22 and a back side 24.

The outer wall 20 has a plurality of plurality of holes 26 each extending through the front side 22 and the back side 24. The holes 26 are spaced apart from each other and are distributed between the top end 16 and the bottom end 18. Each of the holes 26 on the front side 22 is aligned with respective ones of the holes 26 on the back side 24. The back side 24 is positionable against the vertical support surface 14.

The first member 12 has a foot 28 extending away from the front side 22 and the foot 28 is aligned with the bottom end 18. A cup 30 is coupled to and extends away from the first member 12 to receive a muzzle 32 of an automatic rifle 34. The automatic rifle 34 may be an AR-15 or other similar type of automatic, or semi-automatic rifle. The cup 30 has an upper end 36 and an outside wall 38, and the upper end 36 is open. The outside wall 38 is coupled to the foot 28 having the cup 30 being spaced from the first member 12 and the upper end 36 is directed toward the top end 16 of the first member 12.

A second member 40 is provided and the second member 40 is slidably inserted into the first member 12. The second member 40 is mountable to the vertical support surface 14 and the second member 40 has a first portion 42 that is transversely oriented with a second portion 44. The top end 16 of the first member 12 insertably receives the second portion 44 such that the first portion 42 extends along a line that is oriented perpendicular to an axis extending through the top end 16 and the bottom end 18 of the first member 12. Moreover, the first portion 42 is spaceable a selected distance from the top end 16 of the first member 12.

The second member 40 has a front surface 46 and a back surface 48, and the second portion 44 has a plurality of holes 50 each extending through the front surface 46 and the back surface 48. The holes 50 in the second portion 44 are spaced apart from each other and are distributed along an entire length of the second portion 44. A plurality of fasteners 52 is extendable through respective ones of the holes in the first member 12 and engages selected holes in the second portion 44 of the second member 40. In this way the first portion 42 of the second member 40 is retained a selected distance from the top end 16 of the first member 12. Additionally, each of the fasteners 52 engages the vertical support surface 14 for attaching each of the first member 12 and the second member 40 to the vertical support surface 14.

A clamping unit 54 is provided and the clamping unit 54 is coupled to the second member 40. The clamping unit 54 releasably engages a buffer tube 56 of the automatic rifle 34 for storing the automatic rifle 34 in a vertical orientation. The clamping unit 54 comprises a saddle 58 that is coupled to the front surface 46 of the second member 40 corresponding to the first portion 42 of the second member 40. The saddle 58 has a pair of lobes 60 each extending away from the first portion 42, and the lobes 60 are spaced apart from each other to define a buffer tube space 62 between the lobes 60.

A pair of fingers 64 is provided and each of the fingers 64 is pivotally coupled to a respective one of the lobes 60 of the saddle 58. Each of the fingers 64 has a distal end 66 with respect to the respective lobe 60 and the distal end 66 of each of the fingers 64 is directed toward each other. Each of the fingers 64 is pivotable into a receiving position having each of the fingers 64 being directed toward the first portion 42 of the second member 40. In this way the fingers 64 facilitate the buffer tube 56 to be inserted into the buffer tube space 62. Each of the fingers 64 is biased into a home position having each of the fingers 64 extending across the buffer tube space 62. In this way each of the fingers 64 retain the buffer tube 56 in the buffer tube space 62. Each of the fingers 64 is pivotable into a releasing position having each of the fingers 64 being directed away from the first portion 42 of the second member 40. In this way the fingers 64 facilitate the buffer tube 56 to be removed from the buffer tube space 62.

In use, the second member 40 is slid upwardly or downwardly in the first member 12 to facilitate the cup 30 and the clamping unit 54 to be spaced apart from each other a distance sufficient to accommodate the length of the automatic rifle 34. The fasteners are extended through the first member 12 and the second member 40 to attach the first member 12 and the second member 40 to the vertical support surface 14. Additional fasteners are extended through the first portion 42 of the second member 40 to engage the support surface 14. The muzzle 32 of the automatic rifle 34 is positioned in the cup 30 and the buffer tube 56 is inserted into the clamping unit 54. In this way the automatic rifle 34 is stored in a vertical orientation. The buffer tube 56 is pulled forwardly out of the clamping unit 54 and the muzzle 32 is lifted from the cup 30 to remove the automatic rifle 34.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An automatic rifle storage assembly for mounting an automatic rifle to a vertical support surface, said assembly comprising:

a first member being mountable to a vertical support surface;

a cup being coupled to and extending away from said first member wherein said cup is configured to receive a muzzle of an automatic rifle;

a second member being slidably inserted into said first member, said second member being mountable to the vertical support surface;

a clamping unit being coupled to said second member wherein said clamping unit is configured to releasably engage a buffer tube of the automatic rifle for storing the automatic rifle in a vertical orientation;

wherein said second member has a first portion being transversely oriented with a second portion, said second member has a front surface and a back surface, said second portion having a plurality of holes each extending through said front surface and said back surface, said holes in said second portion being spaced apart from each other and being distributed along an entire length of said second portion; and wherein said clamping unit comprises a saddle being coupled to said front surface of said second member on said first portion of said second member, said saddle having a pair of lobes each extending away from said first portion, said lobes being spaced apart from each other to define a buffer tube space between said lobes, and a pair of fingers, each of said fingers being pivotally coupled to a respective one of said lobes of said saddle, each of said fingers having a distal end with respect to said respective lobe, said distal end of each of said fingers being directed toward each other wherein each of said fingers is pivotable into a receiving position having each of said fingers being directed toward said first portion of said second member wherein said fingers are configured to facilitate the buffer tube to be inserted into said buffer tube space.

2. The assembly according to claim 1, wherein said first member has a top end, a bottom end and an outer wall extending therebetween, said top end being open, said first member being hollow, said outer wall having a front side and a back side.

3. The assembly according to claim 2, wherein said outer wall has a plurality of plurality of holes each extending through said front side and said back side, said holes being spaced apart from each other and being distributed between said top end and said bottom end, each of said holes on said front side being aligned with respective ones of said holes on said back side, said back side being positionable against the vertical support surface.

4. The assembly according to claim 2, wherein said first member has a foot extending away from said front side, said foot being aligned with said bottom end.

5. The assembly according to claim 4, wherein said cup has an upper end and an outside wall, said upper end being open, said outside wall being coupled to said foot having said cup being spaced from said first member, said upper end being directed toward said top end of said first member.

6. The assembly according to claim 1, wherein:

said first member has a top end, a bottom end and an outer wall extending therebetween, said top end being open, said first member being hollow, said outer wall having a front side and a back side, said outer wall having a plurality of plurality of holes each extending through said front side and said back side, said holes being spaced apart from each other and being distributed between said top end and said bottom end, each of said holes on said front side being aligned with respective ones of said holes on said back side; and said top end of said first member insertably receives said second portion such that said first portion extends along a line being oriented perpendicular to an axis extending through said top end and said bottom end of said first member, said first portion being spaceable a selected distance from said top end of said first member.

7. The assembly according to claim 6, further comprising a plurality of fasteners being extendable through respective ones of said holes in said first member and engaging selected holes in said second portion of said second member for retaining said first portion of said second member a selected distance from said top end of said first member, each of said fasteners engaging the vertical support surface for attaching each of said first member and said second member to the vertical support surface.

8. The assembly according to claim 1, wherein each of said fingers is biased into a home position having each of said fingers extending across said buffer tube space wherein each of said fingers is configured to retain the buffer tube in said buffer space.

9. The assembly according to claim 8, wherein each of said fingers is pivotable into a releasing position having each of said fingers being directed away from said first portion of said second member wherein said fingers are configured to facilitate the buffer tube to be removed from said buffer tube space.

10. An automatic rifle storage assembly for mounting an automatic rifle to a vertical support surface, said assembly comprising:

a first member being mountable to a vertical support surface, said first member having a top end, a bottom end and an outer wall extending therebetween, said top end being open, said first member being hollow, said outer wall having a front side and a back side, said outer wall having a plurality of holes each extending through said front side and said back side, said holes being spaced apart from each other and being distributed between said top end and said bottom end, each of said holes on said front side being aligned with respective ones of said holes on said back side, said back side being positionable against the vertical support surface, said first member having a foot extending away from said front side, said foot being aligned with said bottom end;

a cup being coupled to and extending away from said first member wherein said cup is configured to receive a muzzle of an automatic rifle, said cup having an upper end and an outside wall, said upper end being open, said outside wall being coupled to said foot having said cup being spaced from said first member, said upper end being directed toward said top end of said first member;

a second member being slidably inserted into said first member, said second member being mountable to the vertical support surface, said second member having a first portion being transversely oriented with a second portion, said top end of said first member insertably receiving said second portion such that said first portion extends along a line being oriented perpendicular to an axis extending through said top end and said bottom end of said first member, said first portion being spaceable a selected distance from said top end of said first member, said second member having a front surface and a back surface, said second portion having a plurality of holes each extending through said front surface and said back surface, said holes in said second portion being spaced apart from each other and being distributed along an entire length of said second portion;

a plurality of fasteners being extendable through respective ones of said holes in said first member and engaging selected holes in said second portion of said second member for retaining said first portion of said second member a selected distance from said top end of said first member, each of said fasteners engaging the vertical support surface for attaching each of said first member and said second member to the vertical support surface; and a clamping unit being coupled to said second member wherein said clamping unit is configured to releasably engage a buffer tube of the automatic rifle for storing the automatic rifle in a vertical orientation, said clamping unit comprising:

a saddle being coupled to said front surface of said second member on said first portion of said second member, said saddle having a pair of lobes each extending away from said first portion, said lobes being spaced apart from each other to define a buffer tube space between said lobes; and a pair of fingers, each of said fingers being pivotally coupled to a respective one of said lobes of said saddle, each of said fingers having a distal end with respect to said respective lobe, said distal end of each of said fingers being directed toward each other, each of said fingers being pivotable into a receiving position having each of said fingers being directed toward said first portion of said second member wherein said fingers are configured to facilitate the buffer tube to be inserted into said buffer tube space, each of said fingers being biased into a home position having each of said fingers extending across said buffer tube space wherein each of said fingers is configured to retain the buffer tube in said buffer space, each of said fingers being pivotable into a releasing position having each of said fingers being directed away from said first portion of said second member wherein said fingers are configured to facilitate the buffer tube to be removed from said buffer tube space.

* * * * *